US007360259B2

(12) United States Patent
Chan

(10) Patent No.: US 7,360,259 B2
(45) Date of Patent: Apr. 22, 2008

(54) TOILET SYSTEM

(76) Inventor: Tien Chan, No. 185, Sec. 1, Shuiyuan Rd., Xizhi City, Taipei County (TW)

( * ) Notice: Subject to any disclaimer, the term of this patent is extended or adjusted under 35 U.S.C. 154(b) by 49 days.

(21) Appl. No.: 11/507,431

(22) Filed: Aug. 22, 2006

(65) Prior Publication Data

US 2008/0047054 A1 Feb. 28, 2008

(51) Int. Cl.
*E03D 11/00* (2006.01)

(52) U.S. Cl. ..... 4/420; 4/300.3; 4/340; 4/449

(58) Field of Classification Search ..... 4/340–342, 4/300.3, 420, 431, 449, 458, 461
See application file for complete search history.

(56) References Cited

U.S. PATENT DOCUMENTS 3,336,602 A * 8/1967 Kubit ..... 4/341
4,197,598 A * 4/1980 Lemmon ..... 4/326
4,240,164 A * 12/1980 Lind ..... 4/449

* cited by examiner

*Primary Examiner*—Charles E. Phillips
(74) *Attorney, Agent, or Firm*—Rosenberg, Klein & Lee

(57) ABSTRACT

A toilet system includes a bowl having an inner space partitioned by a divider into a front and a rear guide way, which are connected to a front and a rear waste pipe, respectively, and the divider defining a front and a rear slope; a vacuum sucker connected at an upper end to the rear waste pipe; and a waste collecting bag connected to a lower end of the vacuum sucker. Excreted urine falls onto the front slope of the divider to flow through the front guide way into the front waste pipe, and is treated and discharged; and excreted stools fall onto the rear slope of the divider and are sucked by the vacuum sucker to move through the rear guide way and the rear waste pipe into the waste collecting bag, which is then removed, frozen, and stored for incinerating or using as fertilizer or fuel later.

1 Claim, 4 Drawing Sheets

TOILET SYSTEM

FIELD OF THE INVENTION

The present invention relates to a toilet system, and more particularly to a toilet system that enables convenient and separate handling of excreted urine and stools on a vehicle to meet environment protection.

BACKGROUND OF THE INVENTION

Since automobile, ship, and airplane are movable vehicles, it is very uneasy to handle waste excreted by passengers and collected by a conventional toilet system provided on these movable vehicles. While the excreted urine can be more easily treated and discharged, the excreted stools are solid waste and could not be handled so easily. In the conventional toilet system, waste is normally flushed off using water. That is, stools are mixed with urine and water and become very difficult to treat, and could not be arbitrarily discharged. Inadequate storage or hiding of the excreted stools would produce bad smell and bring sanitation problem on the vehicles.

SUMMARY OF THE INVENTION

A primary object of the present invention is to provide a toilet system that may be used on an automobile, ship, or airplane to conveniently handle stools in an environment-friendly way.

To achieve the above and other objects, the toilet system according to the present invention includes a bowl having an inner space partitioned by a divider into a front and a rear guide way, the divider having a head portion defining a front and a rear slope, and the front and the rear guide way being connected to a front and a rear waste pipe, respectively; a vacuum sucker being connected at an upper end to a lower end of the rear waste pipe; and a waste collecting bag being connected to a lower end of the vacuum sucker. Excreted urine falls onto the front slope of the divider to flow through the front guide way into the front waste pipe, and is treated and discharged; and excreted stools fall onto the rear slope of the divider and are sucked by the vacuum sucker to move through the rear guide way and the rear waste pipe into the waste collecting bag, which is then removed and instantly frozen and stored for incinerating or using as fertilizer or fuel later.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
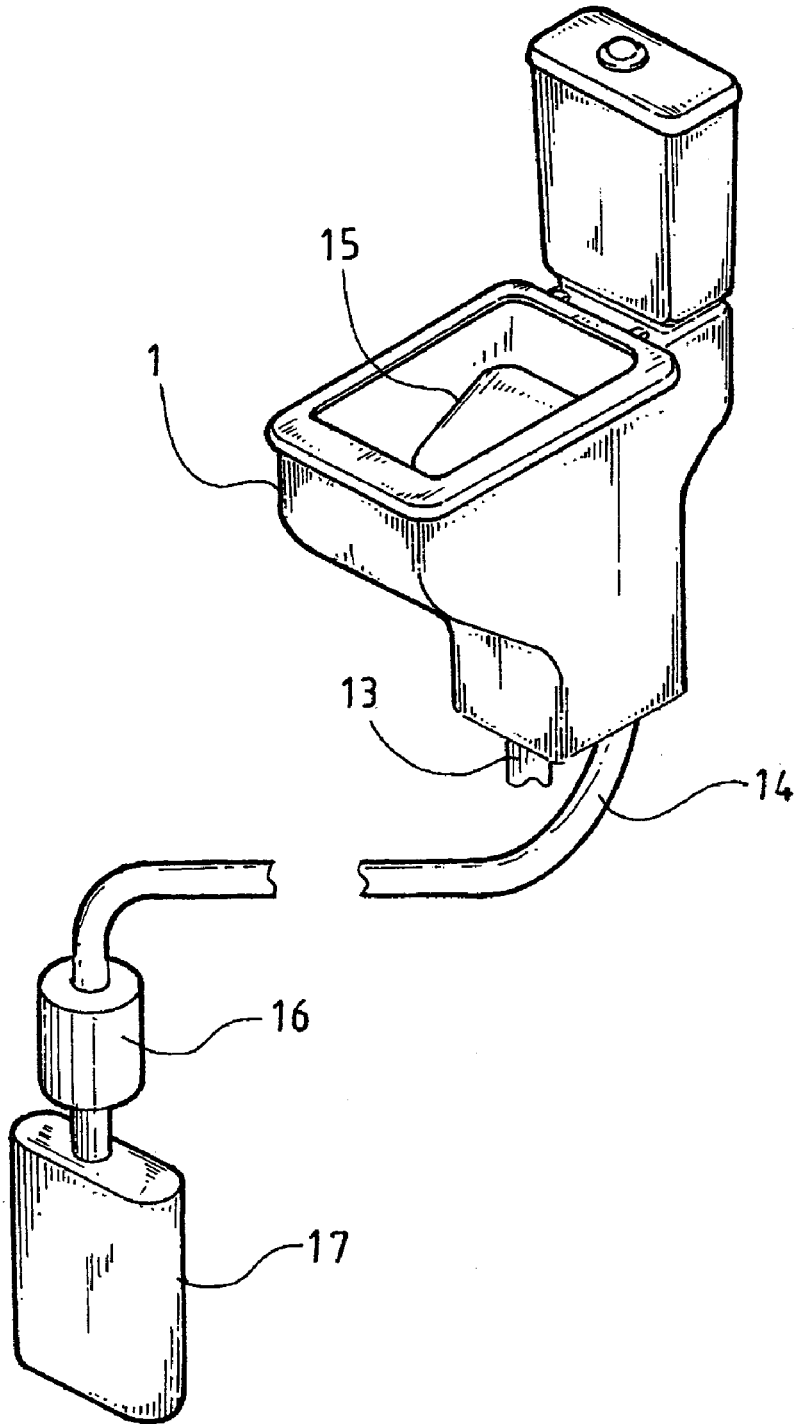
FIG. 1 is a perspective view of a toilet system according to a preferred embodiment of the present invention.
Figure 2:
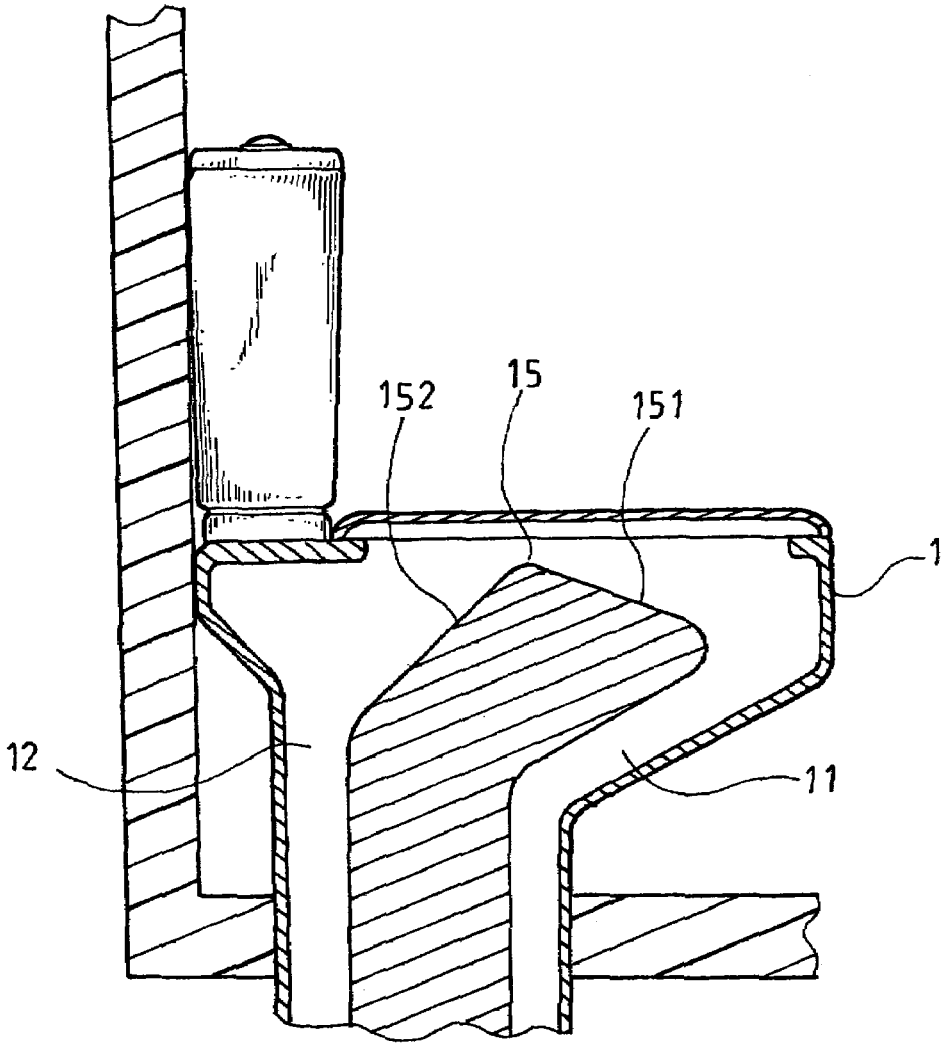
FIG. 2 is a sectional view of a bowl of the toilet system of FIG. 1.
Figure 3:
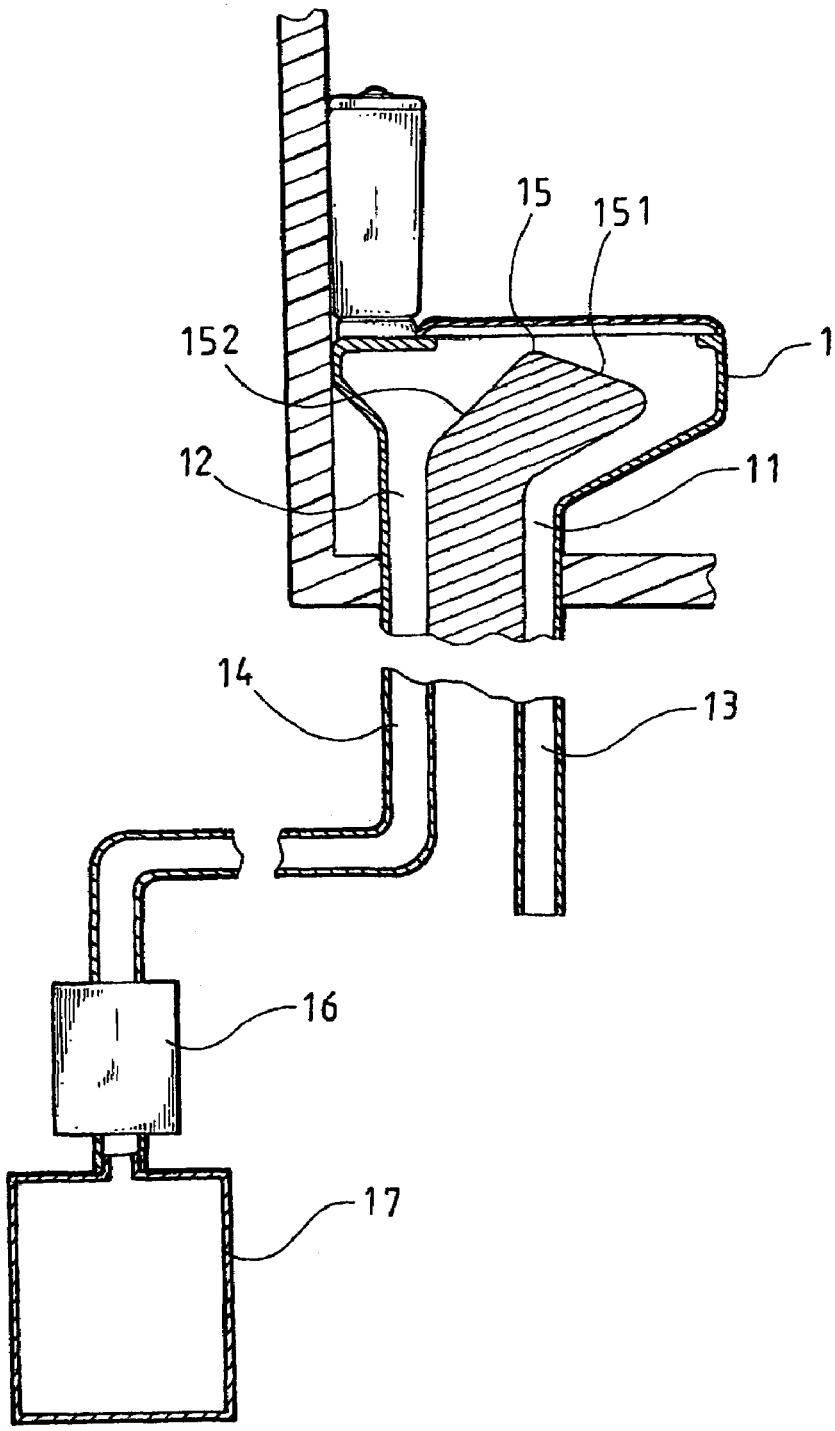
FIG. 3 is a sectional view of the toilet system of FIG. 1.

Please refer to FIGS. 1, 2, and 3 at the same time. In a toilet system according to a preferred embodiment of the present invention, there is included a bowl 1, a vacuum sucker 16, and a waste collecting bag 17.

The bowl 1 is internally provided with a divider 15, so that an inner space of the bowl 1 is partitioned by the divider 15 into a front and a rear guide way 11, 12. The divider 15 has a head portion defining a front and a rear slope 151, 152. The front and the rear guide way 11, 12 downward extend to connect to and communicate with a front and a rear waste pipe 13, 14, respectively. The rear waste pipe 14 has a lower end connected to and communicable with an upper end of the vacuum sucker 16. The waste collecting bag 17 is connected to and communicable with a lower end of the vacuum sucker 16.

The toilet system of the present invention is designed for mounting in a rest room on an automobile, ship, and airplane. Liquid waste, such as urine, falls onto the front slope 151 of the divider 15 and is directed by the front guide way 11 into the front waste pipe 13, at where the liquid waste is treated and then discharged. On the other hand, solid waste, such as stools, fall onto the rear slope 152 of the divider 15 and are directed by the rear guide way 12 into the rear waste pipe 14 under a suction force of the vacuum sucker 16, and finally drop into the waste collecting bag 17. The waste collecting bag 17 filled with stools is then removed from the vacuum sucker 16 and subjected to instant frozen treatment, and stored for incinerating or using as fertilizer and fuel later, so as to meet the requirement of environmental protection.

Figure 4:
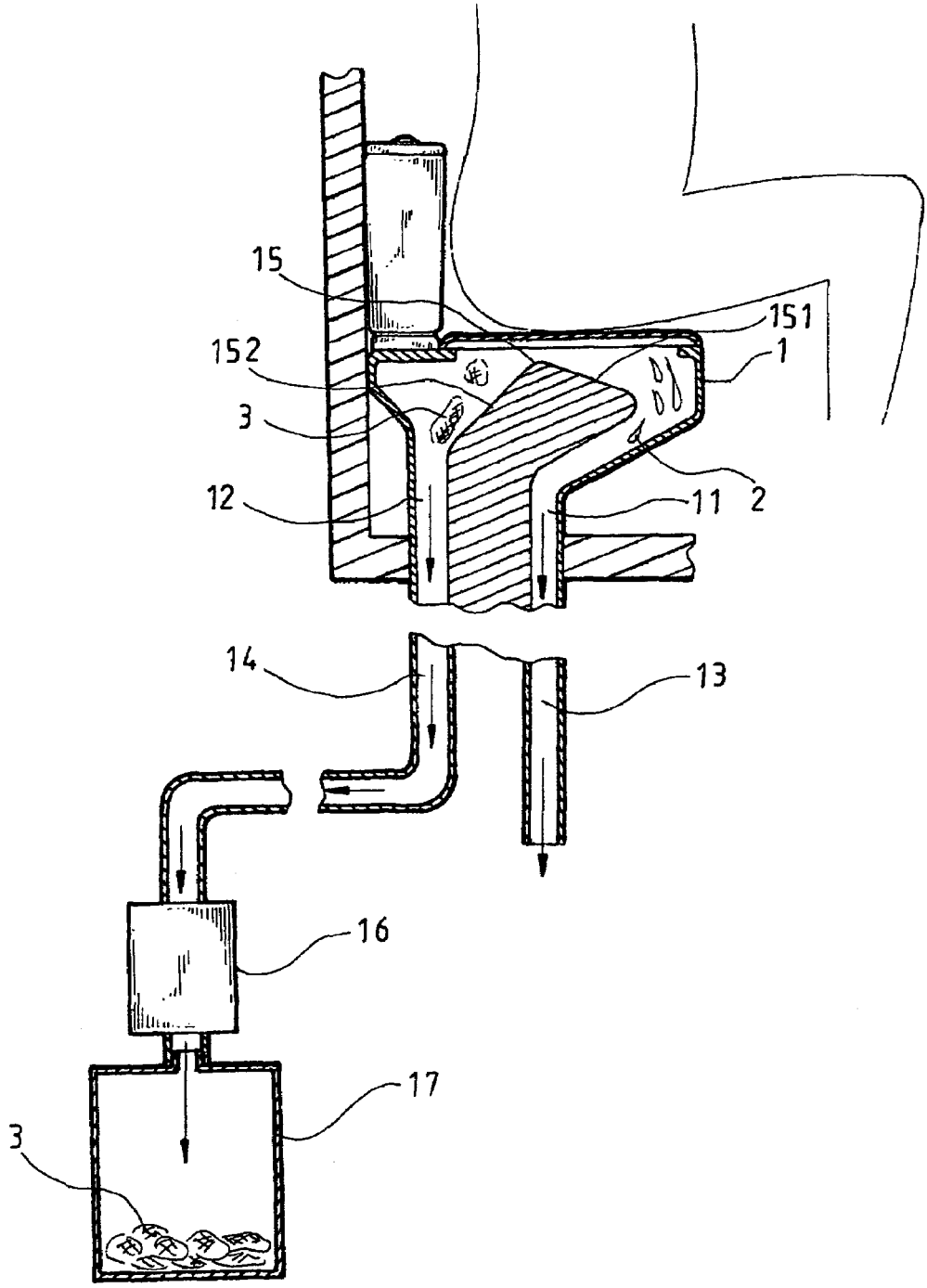
FIG. 4 is a sectional view showing the toilet system of FIG. 1 in use.

FIG. 4 is a sectional view showing the toilet system of the present invention in use. As shown, urine 2 excreted by a passenger falls onto the front slope 151 of the divider 15 and flows into the front guide way 11 to the front waste pipe 13, at where the liquid waste is treated and then discharged. On the other hand, stools 3 fall onto the rear slope 152 of the divider 15 and are sucked by the vacuum sucker 16 to move through the rear guide way 12 and the rear waste pipe 14, and finally drop into the waste collecting bag 17. The waste collecting bag 17 filled with stools 3 is then removed from the vacuum sucker 16 and subjected to instant frozen treatment, and stored for incinerating or using as fertilizer and fuel later, so as to meet the requirement of environmental protection.

With the toilet system of the present invention, either the urine 2 or the stools 3 can be properly treated. Since the excreted stools 3 are separated from the urine 2 at the very beginning without being mixed with the urine 3 to increase the difficulties in handling solid waste, it is easier to maintain an overall sanitation and cleanness of the rest room.

While the above description is based on the mounting of the toilet system of the present invention on an automobile, ship, or airplane, it is understood the toilet system of the present invention may also be used in general buildings in cooperation with the vacuum sucker and the instant frozen treatment to effectively recovery the waste for use as fuel or fertilizer.

What is claimed is:

1. A toilet system, comprising:

a bowl, an inner space of which being partitioned by a divider into a front and a rear guide way, said divider having a head portion defining a front and a rear slope, and said front and said rear guide way being connected to a front and a rear waste pipe, respectively;

a vacuum sucker being connected at an upper end to a lower end of said rear waste pipe; and a waste collecting bag being connected to a lower end of said vacuum sucker;

whereby excreted urine falls onto said front slope of said divider to flow through said front guide way into said front waste pipe, and is treated and discharged; and excreted stools fall onto said rear slope of said divider and are sucked by said vacuum sucker to move through said rear guide way and said rear waste pipe into said waste collecting bag; and said waste collecting bag filled with stools is removed from said vacuum sucker and subjected to instant frozen treatment and stored for incinerating or using as fertilizer or fuel later to meet the requirement of environment protection.

* * * * *